US011011324B2

(12) United States Patent
Kinoshita

(10) Patent No.: US 11,011,324 B2
(45) Date of Patent: May 18, 2021

(54) CONTACT DEVICE

(71) Applicant: Panasonic Intellectual Property Management Co., Ltd., Osaka (JP)

(72) Inventor: Kazuhisa Kinoshita, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 274 days.

(21) Appl. No.: 16/015,109

(22) Filed: Jun. 21, 2018

(65) Prior Publication Data

US 2019/0013158 A1 Jan. 10, 2019

Related U.S. Application Data

(62) Division of application No. 14/710,199, filed on May 12, 2015, now Pat. No. 10,032,570.

(30) Foreign Application Priority Data

May 12, 2014 (JP) ..... 2014-098934

(51) Int. Cl.
*H01H 1/06* (2006.01)
*H01H 50/58* (2006.01)
(Continued)

(52) U.S. Cl.
CPC ..... *H01H 1/06* (2013.01); *H01H 9/46* (2013.01); *H01H 50/541* (2013.01);
(Continued)

(58) Field of Classification Search
CPC ..... H01H 1/06–1/10; H01H 50/642; H01H 2203/002
See application file for complete search history.

(56) References Cited

U.S. PATENT DOCUMENTS 5,109,146 A 4/1992 Maenishi
5,392,015 A 2/1995 Matsuoka et al.
(Continued)

FOREIGN PATENT DOCUMENTS

DE 19854625 A1 6/1999
DE 102007040170 A1 2/2009
(Continued)

OTHER PUBLICATIONS

U.S. Notice of Allowance dated Mar. 22, 2018 issued in U.S. Appl. No. 14/710,199.
(Continued)

*Primary Examiner* — Ramon M Barrera
(74) *Attorney, Agent, or Firm* — McDermott Will and Emery LLP

(57) ABSTRACT

A contact device including a fixed contact member having a fixed contact; and a movable contact member which includes a movable contact and is movable between a position where the movable contact is in contact with the fixed contact and a position where the movable contact is away from the fixed contact, a first contact member which is one of the fixed contact member and the movable contact member further including a recess in a surface to which a first contact of the first contact member is provided. The first contact protrudes toward a second contact of a second contact member which is another of the fixed contact member and the movable contact member, and a periphery of the recess at least partially surrounding a periphery of the first contact in a surface perpendicular to a protruding direction of the first contact.

11 Claims, 11 Drawing Sheets

(51) Int. Cl.

| | |
|---|---|
| ***H01H 50/64*** | (2006.01) |
| ***H01T 4/14*** | (2006.01) |
| ***H01H 9/46*** | (2006.01) |
| ***H01H 50/54*** | (2006.01) |

(52) U.S. Cl.
CPC ..... *H01H 50/58* (2013.01); *H01H 50/642* (2013.01); *H01H 50/645* (2013.01); *H01T 4/14* (2013.01); *H01H 2203/002* (2013.01)

(56) References Cited

U.S. PATENT DOCUMENTS

| | | | | |
|---|---|---|---|---|
| 6,232,570 | B1 | 5/2001 | Castonguay et al. | |
| 6,717,090 | B2 * | 4/2004 | Kling | H01H 9/302 218/149 |
| 7,679,020 | B2 * | 3/2010 | Schulz | H01H 9/446 218/26 |
| 9,484,172 | B2 * | 11/2016 | Connell | H01H 50/14 |
| 2013/0113581 | A1 | 5/2013 | Kakimoto et al. | |
| 2013/0193110 | A1 * | 8/2013 | Hoehne | H01H 33/14 218/146 |
| 2014/0254068 | A1 | 9/2014 | Hashikura et al. | |

FOREIGN PATENT DOCUMENTS

| | | | |
|---|---|---|---|
| EP | 576992 | A2 | 1/1994 |
| EP | 0657907 | A1 | 6/1995 |
| EP | 1085552 | A1 | 3/2001 |
| EP | 2551870 | A1 | 1/2013 |
| JP | S50-049667 | U | 5/1975 |
| JP | S50-096957 | U | 8/1975 |
| JP | S58-192419 | U | 12/1983 |
| JP | S59-196515 | A | 11/1984 |
| JP | S60-070627 | A | 4/1985 |
| JP | H01-283717 | A | 11/1989 |
| JP | H04-118551 | U | 10/1992 |
| JP | H04-312715 | A | 11/1992 |
| JP | H06-215661 | A | 8/1994 |
| JP | 2013-030308 | A | 2/2013 |

OTHER PUBLICATIONS

U.S. Final Office Action dated Nov. 24, 2017 issued in U.S. Appl. No. 14/710,199.

U.S. Non-final Office Action dated Mary 18, 2017 issued in U.S. Appl. No. 14/710,199.

U.S. Non-Final Office Action dated Dec. 13, 2016 issued in U.S. Appl. No. 14/710,199.

U.S. Non-final Office Action dated Jun. 27, 2016 issued in U.S. Appl. No. 14/710,199.

Extended European Search Report issued in European Patent Application No. 15167289.6 dated Sep. 30, 2015.

Notice of Reasons for Refusal issued in Japanese Patent Application No. 2020-004742, dated Nov. 4, 2020; with English translation.

* cited by examiner

CONTACT DEVICE

CROSS-REFERENCE TO RELATED APPLICATIONS

This Application is a Divisional Application of U.S. patent application Ser. No. 14/710,199 filed on May 12, 2015, which claims the benefit of priority of Japanese Patent Application No. 2014-98934, filed on May 12, 2014, the entire contents of which are incorporated herein by reference.

TECHNICAL FIELD

The present invention generally relates to contact devices and in particular relates to a contact device including a fixed contact and a movable contact.

BACKGROUND ART

In the past, there have been proposed electromagnetic relays opening and closing contacts by use of magnetic force caused by electromagnets (see JP 2013-30308 A (hereinafter referred to as "document 1")). The electromagnetic relay disclosed in document 1 includes an electromagnet, an armature to be rotated by magnetic force caused by the electromagnet, a movable contact to move in accordance with a rotation of the armature, and a fixed contact to be in contact or separate from the movable contact.

With regard to this electromagnetic relay, when a current flows through a coil of the electromagnet, the armature is rotated in a direction according to a flow direction of a current in the coil. The movable contact is movable between a position in which the movable contact is in contact with the fixed contact and a position in which the movable contact is separate from the fixed contact, in accordance with such a rotation of the armature.

In the electromagnetic relay disclosed in above document 1, when the movable contact moves away from the fixed contact, an arc may occur between the contacts. By lowering a level difference between a top part of the movable contact (part to be in contact with the fixed contact) and an attachment face of a contact holding member to which the movable contact is attached, the arc can more easily move from the movable contact to the contact holding member. This may be applied to a case of the fixed contact.

However, when the height of the movable contact is decreased in order to decrease the level difference between the top part of the movable contact and the attachment face of the contact holding member, the volume of the movable contact decreases, and therefore lifetime of contacts with regard to on and off operation is likely to be shortened, and the contacts are likely to adhered to each other by melting.

SUMMARY OF INVENTION

In view of the above insufficiency, the present invention has aimed to propose a contact device capable of offering an improved breaking performance without requiring changes in volumes of contacts.

The contact device of one aspect of the present disclosure includes a fixed contact member having a fixed contact; and a movable contact member which includes a movable contact and is movable between a position where the movable contact is in contact with the fixed contact and a position where the movable contact is away from the fixed contact, a first contact member which is one of the fixed contact member and the movable contact member further including a recess in a surface to which a first contact of the first contact member is provided. The first contact protrudes toward a second contact of a second contact member which is an other of the fixed contact member and the movable contact member, and a periphery of the recess at least partially surrounding a periphery of the first contact in a surface perpendicular to a protruding direction of the first contact.

DESCRIPTION OF EMBODIMENTS

Hereinafter, the contact device (electromagnetic relay) of one embodiment in accordance with the present invention is described in detail with reference to attached drawings. Note that, the contact device of the present invention is not limited to the present embodiment, and may have various configurations within the technical scope of the present invention. Unless otherwise noted, the following descriptions are made based on forward and rearward, left and right, and upward and downward directions defined in FIG. 2.

Figure 1:
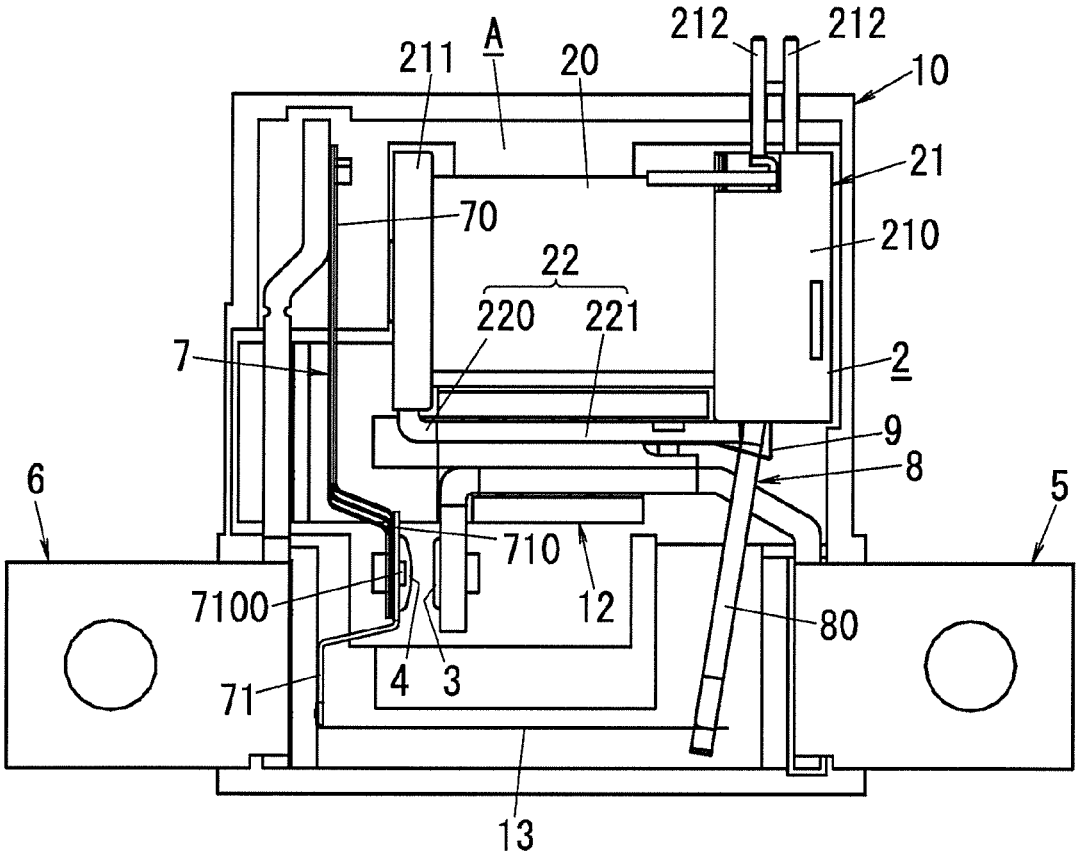
FIG. 1 is a plan illustrating the contact device of one embodiment in accordance with the present invention without the cover.
Figure 2:
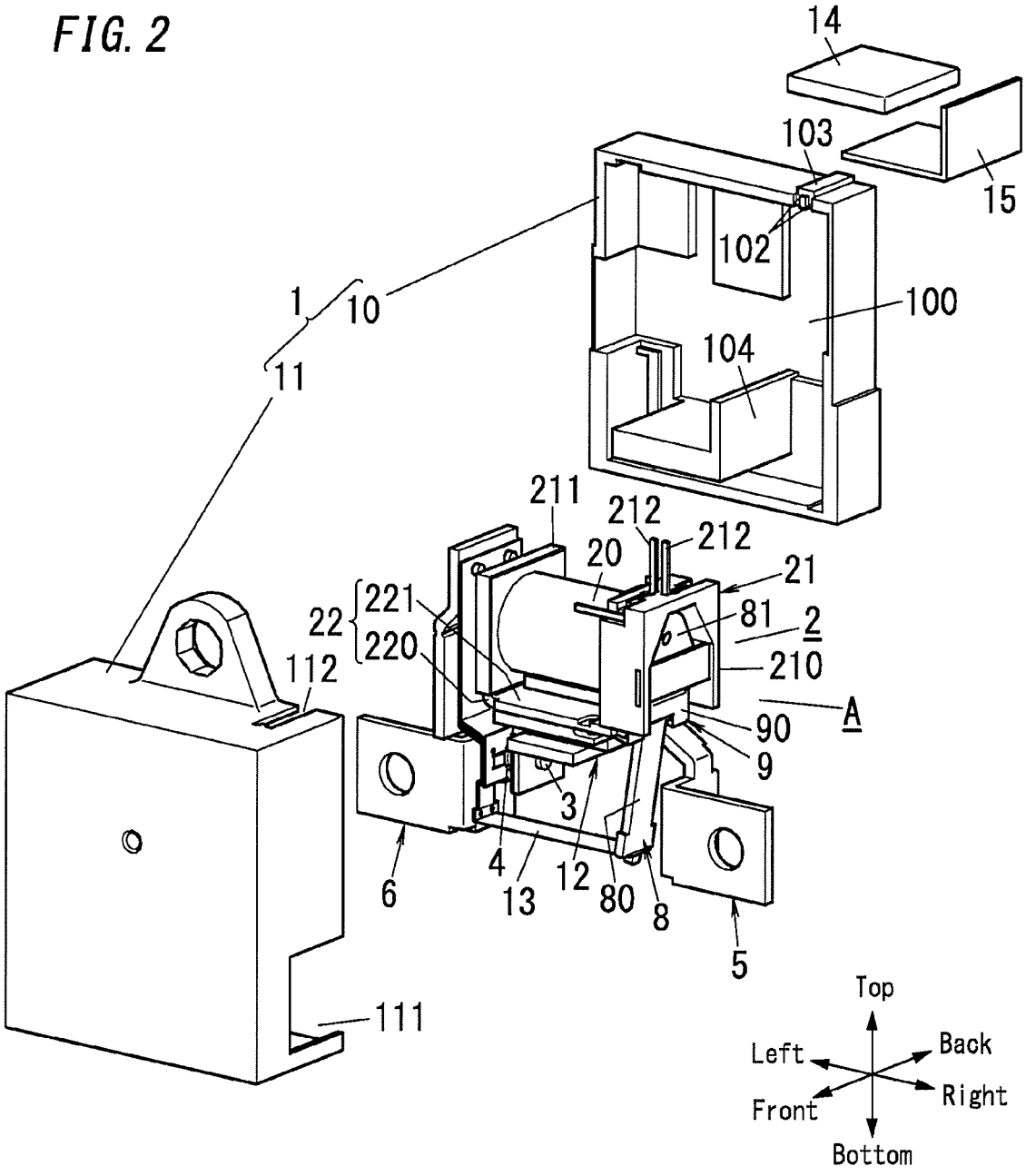
FIG. 2 is an exploded perspective view illustrating the contact device of the embodiment in accordance with the present invention.
Figure 3:
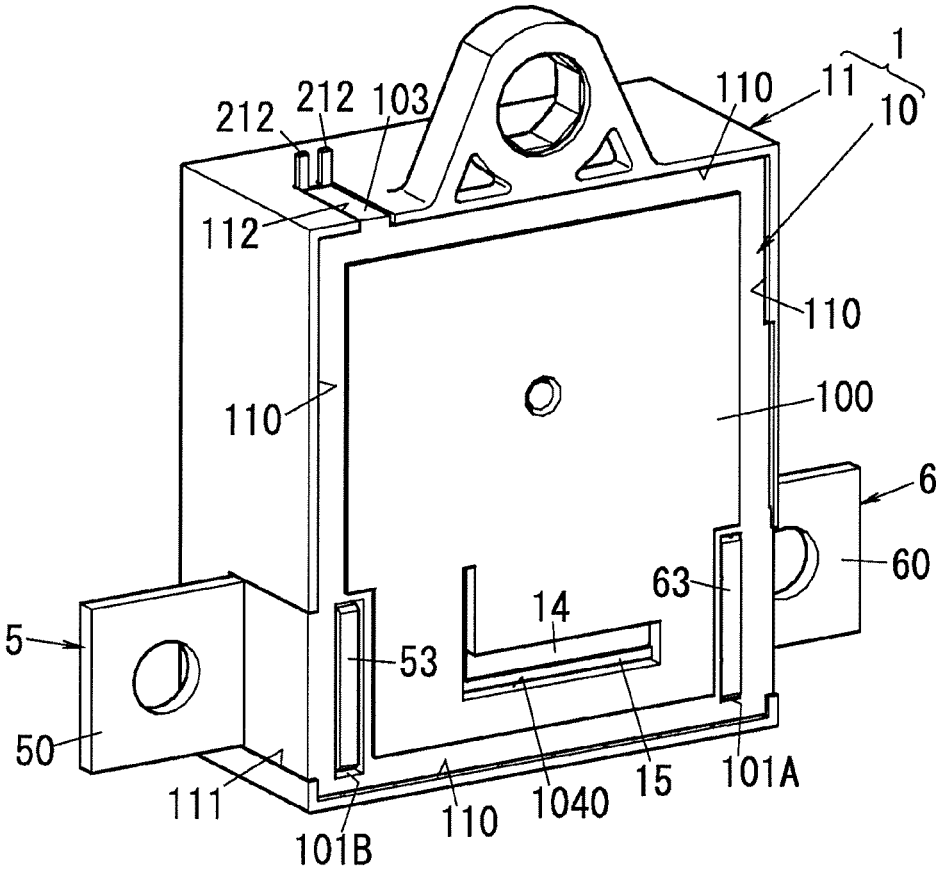
FIG. 3 is a perspective view illustrating the rear side of the contact device of the embodiment in accordance with the present invention.

As shown in FIG. 1 to FIG. 3, the contact device of the present embodiment includes a case (outer casing) 1 constituted by a body 10 and a cover 11. The body 10 is a synthetic resin molded product in a rectangular box shape with an open face. The cover 11 is a synthetic resin molded product in a rectangular box shape with an open face. The case 1 is assembled by covering the body 10 with the cover 11.

Note that, there is a tiny flange 110 protruding inward from the almost entire periphery of an opening of the cover 11. The bottom of the body 10 is caught by the flange 110, and therefore the body 10 and the cover 11 are coupled so that separation of the body 10 and the cover 11 is prevented (see FIG. 3). Alternatively, a coupling method allowing prevention of separation is not limited to the above method. For example, instead of providing the flange 110, the body 10 and the cover 11 may be coupled with adhesive (sealant).

Further, the contact device of the present embodiment includes a relay body A which is constituted by a driving block, a contact block, and a positioning member 12 and is situated in the case 1.

The driving block includes a driver 2, an armature 8, a hinge spring 9, and a card 13. The driver 2 is an electromagnet including a bobbin 21, a coil 20 formed by winding a wire around the bobbin 21, an iron core situated in a center of the bobbin 21, and a heel piece 22.

The bobbin 21 includes a barrel inside the coil 20, a first flange 210 provided to one axial end of the barrel, and a second flange 211 provided to the other axial end of the barrel. Note that, in this bobbin 21, it is preferable that the barrel and the pair of flanges 210 and 211 be formed integrally by use of insulating material such as synthetic resin.

The first flange 210 is in a flat rectangular box shape with one open bottom (right side) and one open side (lower face) (see FIG. 2). There is a pair of coil terminals 212 protruding outward (upward) in a diameter direction of the barrel from a side (upper face) of the first flange 210. The pair of coil terminals 212 are individually connected to both ends of the coil 20. When a voltage is applied between the pair of coil terminals 212 and 212, current flows through the coil 20 and therefore the driver (electromagnet) 2 is excited.

The heel piece 22 is in an L-shape, and includes a holding piece 220 held by the second flange 211, and a main piece 221 extending from an end of the holding piece 220 to the first flange 210 which are formed integrally by use of magnetic material (see FIG. 1).

The armature 8 includes a driving piece 80 in a band plate shape, and a supporting piece 81 which is in a flat plate shape and is wider than the driving piece 80. The driving piece 80 and the supporting piece 81 are formed integrally by use of magnetic material. The supporting piece 81 is accommodated in the first flange 210, and is fixed to a first fixing piece 90 of the hinge spring 9 (see FIG. 2 and FIG. 6). Further, the supporting piece 81 faces an end of the iron core exposed on an inner bottom of the first flange 210.

The driving piece 80 protrudes to an outside of the first flange 210 through the open side (lower face) of the first flange 210. Further, the driving piece 80 abuts on a front end of the main piece 221 of the heel piece 22 (see FIG. 4). Note that, there is a projection 82 in a cuboidal shape provided to a front end face (lower end face) of the driving piece 80.

The hinge spring 9 includes the first fixing piece 90, a second fixing piece 91, and a pair of spring pieces 92. The first fixing piece 90, the second fixing piece 91, and the pair of spring pieces 92 are formed integrally by use of a plate spring (see FIG. 6). The first fixing piece 90 is in a rectangular flat plate shape and is fixed (swaged) to the supporting piece 81 of the armature 8. The second fixing piece 91 is in a rectangular flat plate shape, and is fixed (swaged) to the main piece 221 of the heel piece 22. The pair of spring pieces 92 each are in an L-shape, and include opposite ends in a length direction coupled to the first fixing piece 90 and the second fixing piece 91, respectively.

When the armature 8 is driven by the driver 2, the armature 8 turns around a fulcrum defined by a part of the armature 8 in contact with the main piece 221 of the heel piece 22, in a direction (counterclockwise in FIG. 1) in which the supporting piece 81 moves close to the iron core. When the armature 8 is not driven by the driver 2, the armature 8 turns in a direction (clockwise in FIG. 1) in which the supporting piece 81 moves away from the iron core.

The contact block includes a fixed contact 3, a movable contact 4, a first terminal 5, a second terminal 6, and a contact spring 7.

Figure 4:
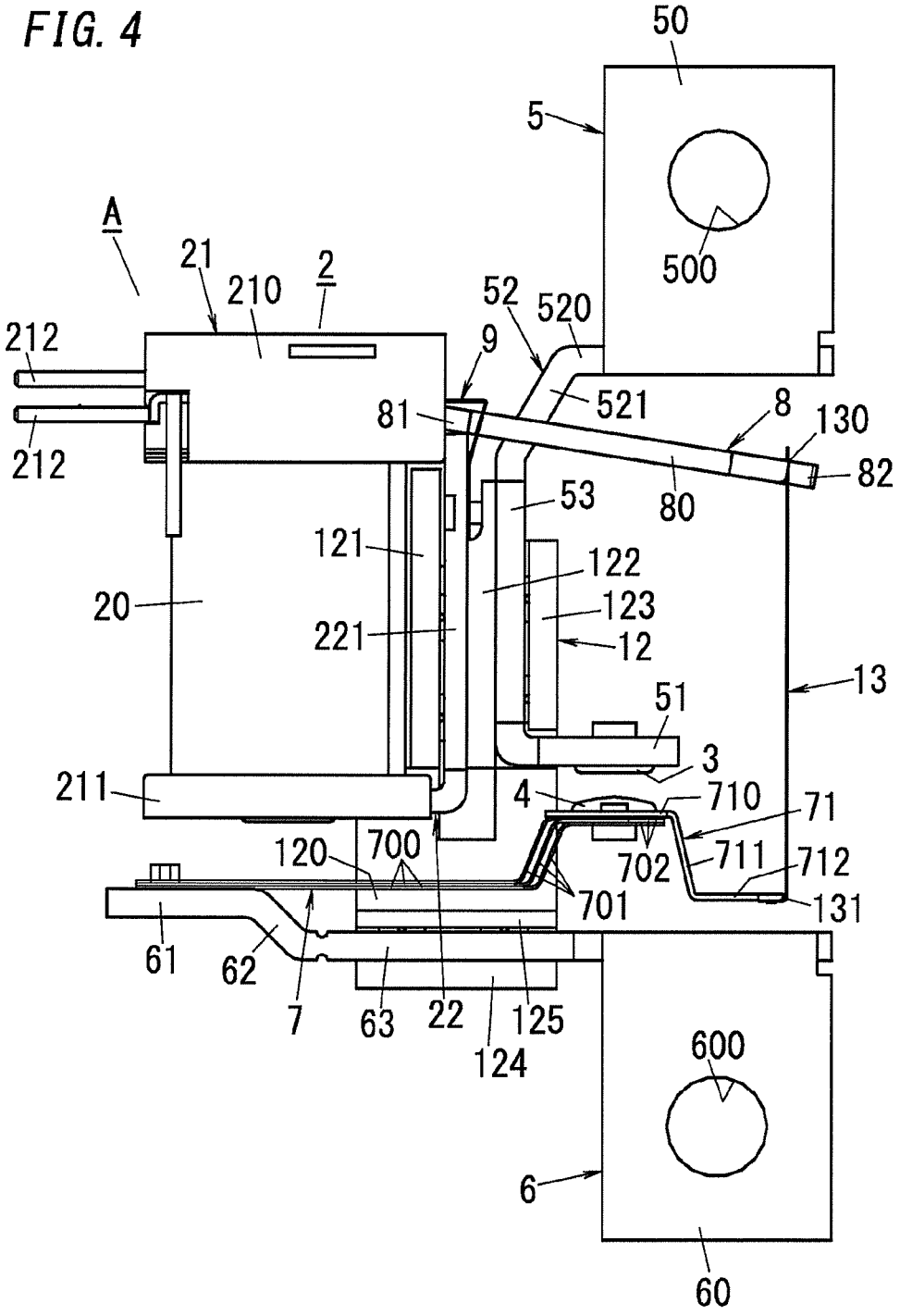
FIG. 4 is a front view illustrating the relay body of the contact device of the embodiment in accordance with the present invention.
Figure 6:
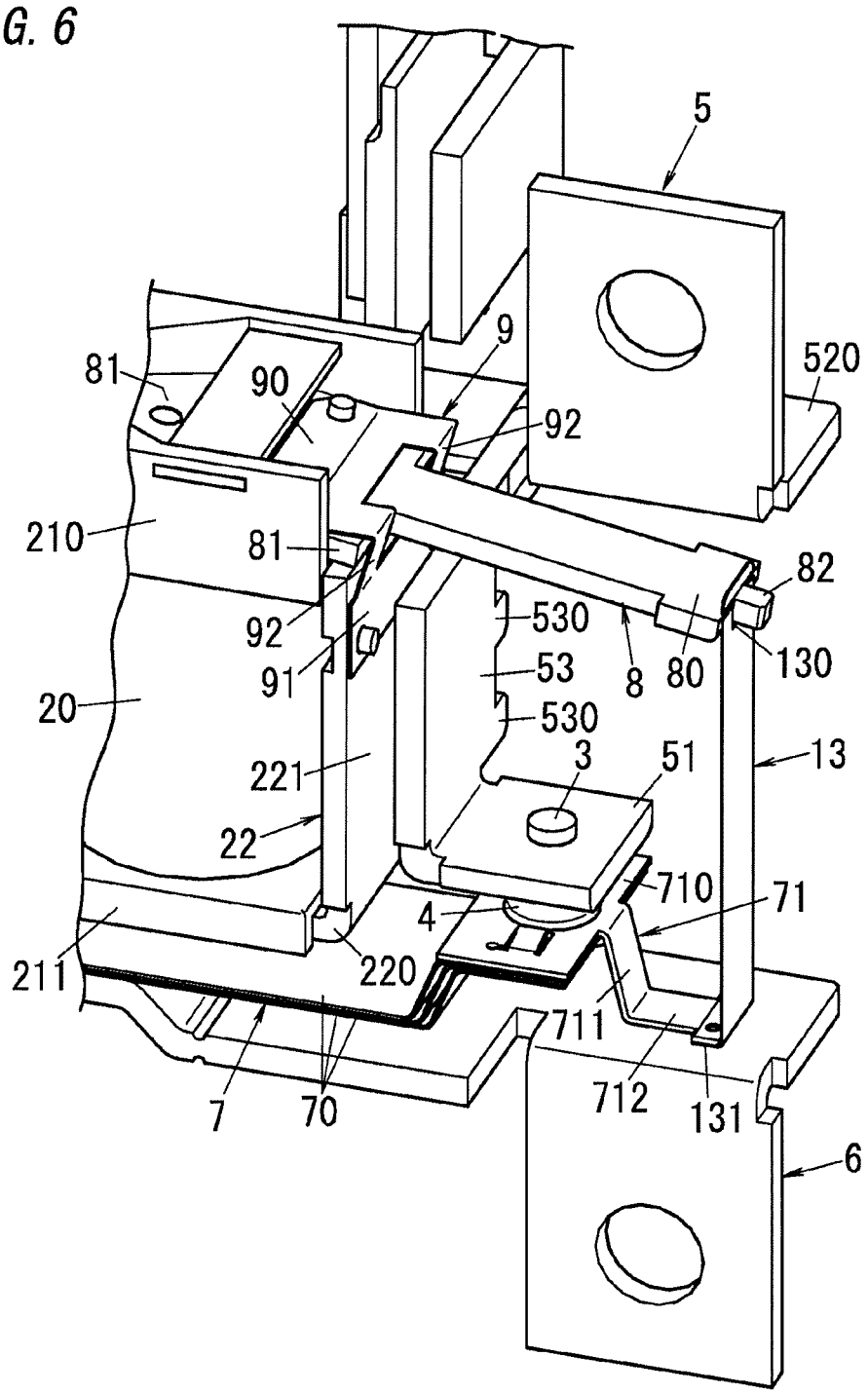
FIG. 6 is a partial perspective view illustrating the relay body of the contact device of the embodiment in accordance with the present invention.
Figure 7D:
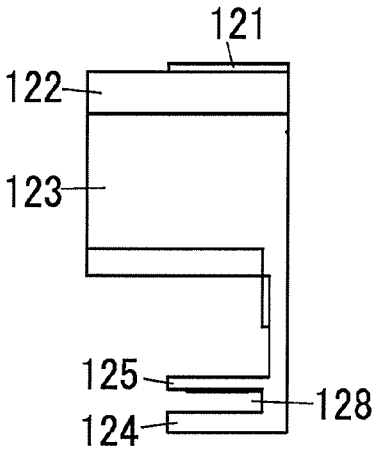
FIG. 7A, FIG. 7B, FIG. 7C, FIG. 7D, FIG. 7E, and FIG. 7F are front, left side, right side, top, bottom, and rear views of the positioning member of the contact device of the embodiment in accordance with the present invention, respectively.
Figure 7B:
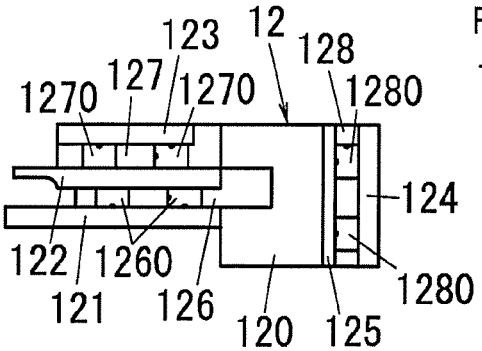
Figure 7A:
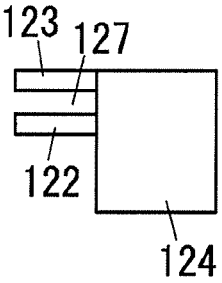
Figure 7C:
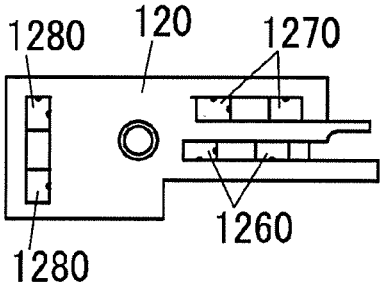
Figure 7E:
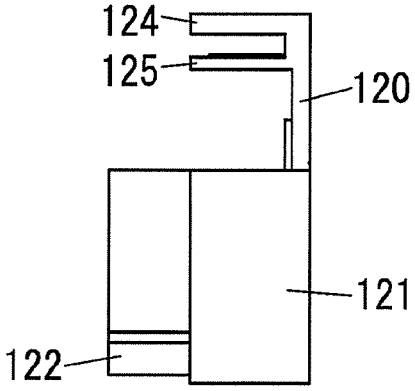
Figure 7F:
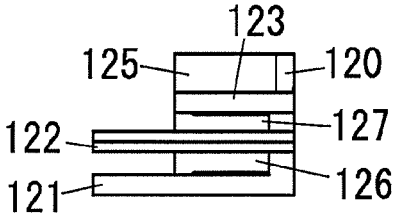

The contact spring 7 includes multiple (three in the present embodiment) plate springs 70 and an interconnection member 71 (see FIG. 4). The plate spring 70 includes a main piece 700 in a band shape, an inclined piece 701 extending obliquely from a front end (lower end) of the main piece 700, and an attachment piece 702 in a rectangular shape protruding from a front end (lower end) of the inclined piece 701 in parallel with the main piece 700. As shown in FIG. 6, these three plate springs 70 are coupled with each other so that the main pieces 700 are in a stack and the attachment pieces 702 are in a stack.

The interconnection member 71 includes an attachment part 710 in a rectangular shape, an inclined part 711 protruding obliquely downward from a center of a lower end of the attachment part 710, and a connection piece 712 extending from a front end (lower end) of the inclined part 711 in parallel with the attachment part 710 (see FIG. 4).

The attachment part 710 is situated on the attachment pieces 702 of the plate springs 70. The movable contact 4 is provided to a surface (right side) of the attachment part 710 so as to penetrate through the three attachment pieces 702 and the attachment part 710. Further, in the connection piece 712, a front end (lower end) part is wider than a remaining part. The connection piece 712 is coupled to the card 13 at the wide front end part.

Further, the contact spring 7 is connected to the second terminal 6 at a further end part (upper end of the main piece 700) of the plate spring 70 (see FIG. 4). The second terminal 6 includes a terminal piece 60, a fixing piece 61, an inclined piece 62, and an interconnection piece 63, which are formed integrally by use of metal. The terminal piece 60 is in a rectangular flat plate shape, and includes a screw hole 600 penetrating through its center. A terminal screw is screwed into the screw hole 600.

The fixing piece 61 is in a rectangular flat plate shape, and the further end (upper end) of the plate spring 70 of the contact spring 7 is fixed (swaged) to the fixing piece 61. The inclined piece 62 is in a rectangular flat plate shape, and extends obliquely downward (in a left lower direction) from the lower end of the fixing piece 61. The interconnection piece 63 is in a rectangular flat plate shape, and interconnects the upper end of the terminal piece 60 and the lower end of the inclined piece 62.

The fixed contact 3 which is to be in contact with the movable contact 4 is provided to the first terminal 5. The first terminal 5 includes a terminal piece 50, an attachment piece 51, a supporting piece 52, and an interconnection piece 53, which are formed integrally by use of metal. The terminal piece 50 is in a rectangular flat plate shape, and includes a screw hole 500 penetrating through its center. A terminal screw is screwed into the screw hole 500.

The attachment piece 51 is in a rectangular flat plate shape, and the fixed contact 3 is attached to a center of the attachment piece 51. The supporting piece 52 includes: a main piece 520 having the front end connected to the terminal piece 50; and an inclined piece 521 extending obliquely upward from the upper edge of the main piece 520. The interconnection piece 53 is in a rectangular flat plate shape, and interconnects the upper end of the inclined piece 521 and the right end of the attachment piece 51.

In the present embodiment, the fixed contact 3 and the first terminal 5 constitute a fixed contact member, and the movable contact 4, the second terminal 6 and the contact spring 7 constitute a movable contact member.

The card 13 of the driving block is made of resilient material (e.g., a metal plate), and is fixed to each of the armature 8 and the contact spring 7.

Figure 5:
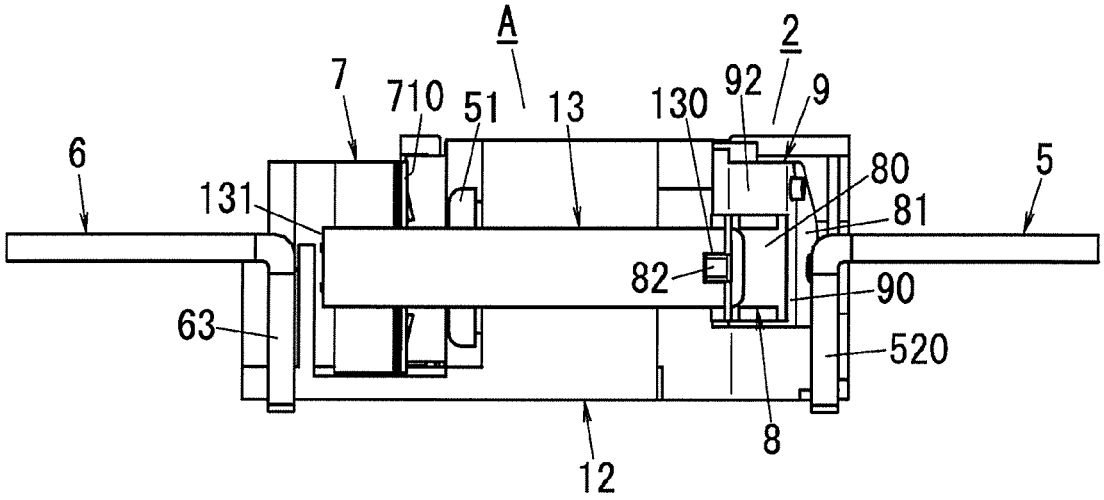
FIG. 5 is a right side view illustrating the relay body of the contact device of the embodiment in accordance with the present invention.

The card 13 is in a band shape as shown in FIG. 5 and FIG. 6, and includes one end in a length direction through which a rectangular hole 130 penetrates, and another end in the length direction bent at the right angle to extend in a thickness direction of the card 13. The card 13 is fixed to the armature 8 by swaging the projection 82 inserted into the hole 130. Further, in the card 13, the part which is bent at the right angle (hereinafter referred to as a second fixing part 131) is fixed (swaged) to the contact spring 7 (the connection piece 712 of the interconnection member 71).

As shown in FIGS. 7A-7F, the positioning member 12 is a synthetic resin molded product including a bottom wall 120, a first longitudinal wall 121, a second longitudinal wall 122, a third longitudinal wall 123, a fourth longitudinal wall 124, and a fifth longitudinal wall 125 which are formed integrally.

The bottom wall 120 is in a flat hook shape. The first longitudinal wall 121 to the fifth longitudinal wall 125 are in an almost rectangular flat plate shape, and extend in the same direction from a surface of the bottom wall 120. The first longitudinal wall 121, the second longitudinal wall 122, and the third longitudinal wall 123 are arranged in parallel with each other at intervals on a narrow part of the bottom wall 120.

Note that, a space between the first longitudinal wall 121 and the second longitudinal wall 122 is defined as a first groove 126, and a space between the second longitudinal wall 122 and the third longitudinal wall 123 is defined as a second groove 127. The fourth longitudinal wall 124 and the fifth longitudinal wall 125 are arranged in parallel with each other at an interval on an end of a broad part of the bottom wall 120. Note that, a space between the fourth longitudinal wall 124 and the fifth longitudinal wall 125 is defined as a third groove 128.

Further, with regard to the bottom wall 120, a pair of holding holes (first holding holes) 1260 are arranged in a length direction of the first groove 126 in a bottom of the first groove 126. Further, with regard to the bottom wall 120, a pair of holding holes (second holding holes) 1270 are arranged in a length direction of the second groove 127 in a bottom of the second groove 127. Furthermore, with regard to the bottom wall 120, a pair of holding holes (third holding holes) 1280 are arranged in a length direction of the third groove 128 in a bottom of the third groove 128.

Each of the pair of first holding holes 1260, the pair of second holding holes 1270, and the pair of third holding holes 1280 is a rectangular through hole penetrating through the bottom wall 120. Note that, protrusions are provided to an inner circumferential surface of each of the first holding holes 1260, the second holding holes 1270, and the third holding holes 1280.

The main piece 221 of the heel piece 22 constituting the driver 2 is inserted into the first groove 126. This main piece 221 includes a pair of protrusions. The pair of protrusions are pressed into the first holding holes 1260, and thereby the main piece 221 of the heel piece 22 is held and positioned in the first groove 126 (see FIG. 4).

Further, the interconnection piece 53 of the first terminal 5 is inserted into the second groove 127. The interconnection piece 53 also includes a pair of protrusions 530 (see FIG. 6). The pair of protrusions 530 are pressed into the second holding holes 1270, and thereby the interconnection piece 53 of the first terminal 5 is held and positioned in the second groove 127 (see FIG. 4).

Further, the interconnection piece 63 of the second terminal 6 is inserted into the third groove 128. The interconnection piece 63 also includes a pair of protrusions.

The pair of protrusions are pressed into the third holding holes 1280, and thereby the interconnection piece 63 of the second terminal 6 is held and positioned in the third groove 128 (see FIG. 4).

In summary, the positioning member 12 is configured to define a positional relationship between the armature 8, the driver 2, the fixed contact 3, the movable contact 4, the contact spring 7, and the card 13. Further, the driver 2, the first terminal 5, and the second terminal 6 are held by the positioning member 12 to constitute the relay body A.

There are rectangular holes 101A and 101B penetrating through left and right corners of a lower part of a bottom plate 100 of the body 10 respectively. Further, there are multiple protrusions provided to an inner circumferential surface of the left hole 101A. A rear end part of the interconnection piece 63 of the second terminal 6 is inserted into the left hole 101A. Further, a rear end part of the main piece 520 of the first terminal 5 is inserted into the right hole 101B. In short, the relay body A is accommodated in the body 10 while the rear end of the interconnection piece 63 of the second terminal 6 is supported on the body 10 (see FIG. 1).

Further, when the relay body A is accommodated in the body 10, the coil terminals 212 of the driver 2 protrude to an outside of the body 10 through a groove 102 provided to an upper side plate of the body 10 (see FIG. 1). Note that, there is a cuboidal rib 103 which has a length direction parallel to the forward and rearward direction and protrudes outward (upward) from a surface (upper face) of the side plate.

In the body 10, there is an arc extinguishing member placed inside a space surrounded by the driver 2, the armature 8, contacts (the fixed contact 3 and the movable contact 4), and the card 13. The arc extinguishing member is constituted by a permanent magnet 14 and a yoke 15. The permanent magnet 14 is in a rectangular flat plate shape, and is magnetized to have different poles in a thickness direction. In the forward and rearward direction, the yoke 15 is in an L-shape. The permanent magnet 14 and the yoke 15 are accommodated in an accommodation part 104 provided to the body 10.

The accommodation part 104 is in a box shape whose outer shape is an L-shape in the forward and rearward direction, and protrudes forward from the bottom plate 100 of the body 10 (see FIG. 2). Further, the accommodation part 104 is hollow, and therefore the permanent magnet 14 and the yoke 15 are inserted into the accommodation part 104 through an insertion opening 1040 formed in a rear side of the body 10 and are accommodated (see FIG. 3).

Next, a process of assembling the contact device of the present embodiment is briefly described.

First, the second fixing part 131 of the card 13 is engaged with the connection piece 712 of the contact spring 7, and thereafter the driver 2, the first terminal 5, and the second terminal 6 are held by the positioning member 12. Thereafter, the first fixing part (hole 130) of the card 13 is engaged with the projection 82 of the armature 8, and thereby the relay body A is assembled.

Subsequently, the relay body A is accommodated in the body 10. At this time, the rear end part of the interconnection piece 63 of the second terminal 6 is pressed into the hole 101A of the bottom plate 100 of the body 10, and thereby the relay body A is positioned and fixed to the body 10. Further, by covering the cover 11 with the body 10 from front, the case 1 is assembled. At last, the permanent magnet 14 and the yoke 15 are accommodated in the accommodation part 104 of the body 10, and thereby assembling of the contact device of the present embodiment is completed.

Note that, there are cut-outs 111 formed in left and right side walls of the cover 11 to allow the terminal piece 50 of the first terminal 5 and the terminal piece 60 of the second terminal 6 to protrude outside (see FIG. 2 and FIG. 3). Further, there is a groove 112 in an upper side wall of the cover 11, and this groove 112 receives the rib 103 of the body 10 (see FIG. 3).

Next, operation of the contact device of the present embodiment is described with reference to FIG. 1.

While no voltage is applied between the coil terminals 212, the driver 2 does not operate the armature 8. Therefore, the contact spring 7 is not pulled by the card 13, and the movable contact 4 and the fixed contact 3 face each other to form a predetermined gap therebetween. At this time, the first terminal 5 and the second terminal 6 are in a non-conduction state (off-state).

In contrast, while a voltage is applied between the coil terminals 212, the driver 2 operates the armature 8, and the armature 8 rotates counterclockwise. Therefore, the contact spring 7 is pulled by the card 13 and is bent in a right direction. Therefore, the movable contact 4 is in contact with the fixed contact 3. At this time, the first terminal 5 and the second terminal 6 are in a conduction state (on-state).

Note that, when a voltage is not applied between the coil terminals 212 in the on-state, the armature 8 rotates clockwise, and the contact device returns to the off-state.

When the contact returns from the on-state to the off-state, arc discharge may occur between the movable contact 4 and the fixed contact 3. When arc discharge occurs, it is necessary to extinguish the resultant arc in order to end arc discharge in short time.

In view of this, the contact device of the present embodiment accommodates, in the accommodation part 104 of the body 10, the arc extinguishing member constituted by the permanent magnet 14 and the yoke 15. In more details, the permanent magnet 14 and the yoke 15 form a magnetic field around the fixed contact 3 and the movable contact 4, and thereby an arc is elongated by electromagnetic force caused by the magnetic field, and this results in extinguishment of the arc.

When the movable contact 4 moves away from the fixed contact 3, an arc may occur between the movable contact 4 and the fixed contact 3. This arc may melt the movable contact 4 and the fixed contact 3, and therefore it is preferable to move such an arc away from the movable contact 4 and the fixed contact 3.

For example, one of methods of moving the arc away from the movable contact 4 may be a method of reducing a level difference between a top part of the movable contact 4 (part to be in contact with the fixed contact 3) and the surface of the attachment part 710. In this method, when the height of the movable contact 4 is reduced, the arc occurring on the movable contact 4 easily moves toward the surface of the attachment part 710. However, the volume of the movable contact 4 is decreased, and therefore lifetime of contacts regarding on and off operation may be shortened, and contacts are likely to adhere to each other by melting.

In view of this, the present embodiment can solve the above problem by the following method without changing the height of the movable contact 4.

Figure 8:
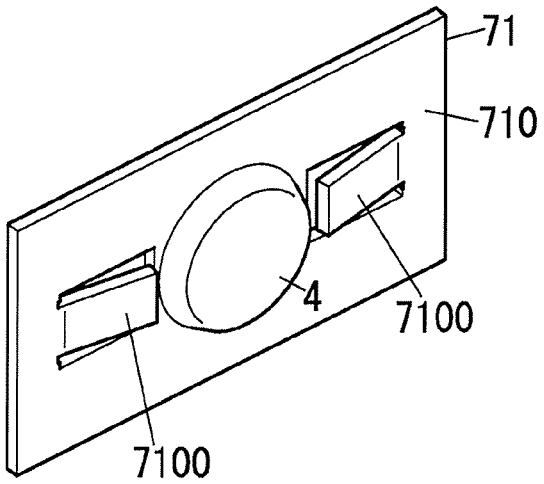
FIG. 8 is an enlarged view illustrating the primary part of the contact device of the present embodiment.

FIG. 8 is an enlarged view illustrating a primary part of the contact device of the present embodiment. In the present embodiment, protrusions 7100 are provided to the attachment part 710 to obtain the same effect as in a case where a level difference between the top part of the movable contact 4 and the surface of the attachment part 710 (face to which the movable contact 4 is provided) is decreased. In more details, the movable contact 4 is attached to a center of the attachment part 710 in a rectangular plate shape elongated in the forward and rearward direction, and a pair of protrusions 7100 are provided to opposite sides with regard to the movable contact 4 in the forward and rearward direction. Each protrusion 7100 is formed by cutting and arising part of the attachment part 710.

In each protrusion 7100, an end close to the movable contact 4 in the forward and rearward direction and both ends in the upward and downward direction are separated from the attachment part 710 by cutting, and the end close to the movable contact 4 is made to protrude in the same direction as the protruding direction of the movable contact 4. Consequently, it is possible to obtain the same effect as in the case where the level difference between the top part of the movable contact 4 and the surface of the attachment part 710 is decreased.

In this case, even if the volume of the movable contact 4 is not decreased, the arc occurring on the movable contact 4 may easily move from the movable contact 4 to the protrusion 7100 of the attachment part 710. As a result, in contrast to a case where the protrusion 7100 is not provided, the lifetime of contacts can be prolonged. Further, the volume of the movable contact 4 is not decreased, there are advantages that the lifetime of contacts with regard to the on and off operation can be maintained and adhesion of the movable contact 4 caused by melting is not likely to occur. Further, a necessary step is only cutting and arising part of the attachment part 710, and therefore there are advantages that processing becomes easy and it is easy to adjust the level difference after assembling.

Figure 9A:
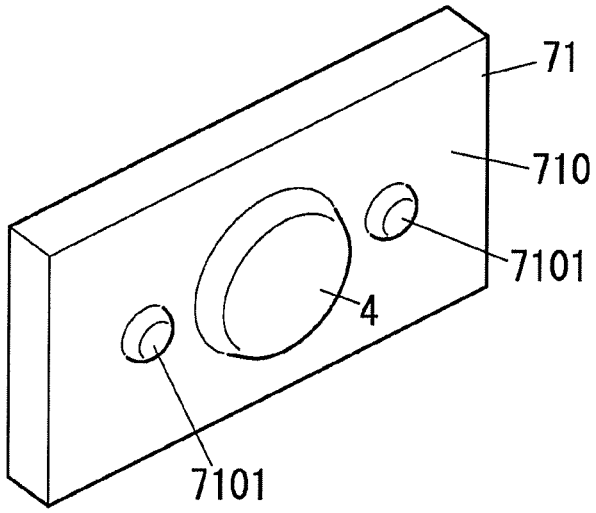
FIG. 9A, FIG. 9B and FIG. 9C are enlarged views illustrating the primary parts of other examples of the contact device of the present embodiment.
Figure 9B:
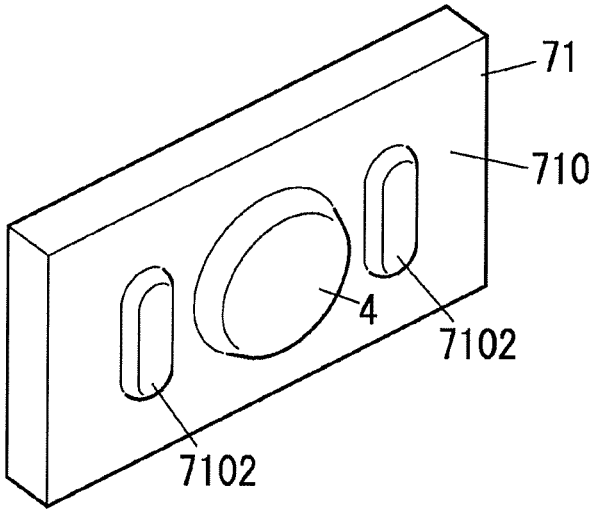
Figure 9C:
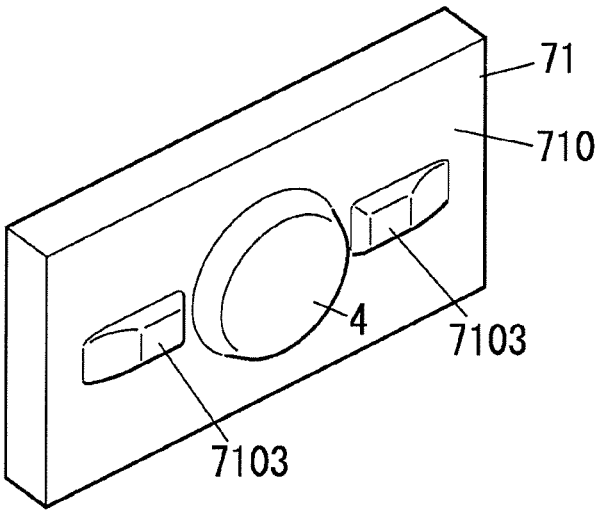

FIG. 9A to FIG. 9C are enlarged views illustrating primary parts of other examples of the contact device of the present embodiment. In the example shown in FIG. 8, the protrusion 7100 is formed by cutting and arising part of the attachment part 710 of the interconnection member 71. However, if the protrusion 7100 protrudes toward the fixed contact 3, that is, in the same direction as the protruding direction of the movable contact 4, the protrusion 7100 may be in another shape.

In FIG. 9A, protrusions 7101 are formed on the attachment part 710 so as to be in front of and in back of the movable contact 4. Each protrusion 7101 is formed by making protruding part of the attachment part 710 in the same direction as the protruding direction of the movable contact 4 to be in a semispherical shape. In FIG. 9B, protrusions 7102 are formed on the attachment part 710 so as to be in front of and in back of the movable contact 4. Each protrusion 7102 is part of the attachment part 710 and is elongated in the upward and downward direction and protrudes in the same direction as the protruding direction of the movable contact 4. In FIG. 9C, protrusions 7103 are formed on the attachment part 710 so as to be in front of and in back of the movable contact 4. Each protrusion 7103 is part of the attachment part 710 and is elongated in the forward and rearward direction and protrudes in the same direction as the protruding direction of the movable contact 4.

In these cases, even if the volume of the movable contact 4 is not decreased, the arc occurring on the movable contact 4 may easily move from the movable contact 4 to the protrusion 7101 to 7103 of the attachment part 710. As a result, in contrast to a case where the protrusion 7101 to 7103 is not provided, the lifetime of contacts can be prolonged. Further, the volume of the movable contact 4 is not decreased, there are advantages that the lifetime of contacts with regard to the on and off operation can be maintained and adhesion of the movable contact 4 caused by melting is not likely to occur.

Further, a necessary step is only making part of the attachment part 710 to protrude in the same direction as the protruding direction of the movable contact 4, and therefore there are advantages that processing becomes easy and the degree of freedom in shape is high.

Figure 10A:
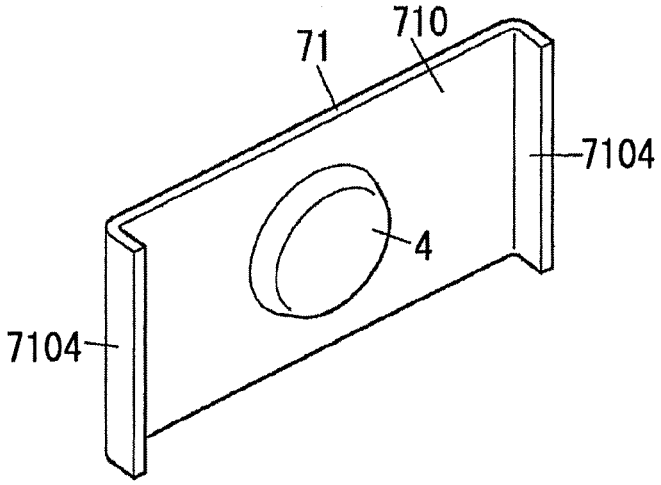
FIG. 10A to FIG. 10C are enlarged views illustrating the primary parts of other examples of the contact device of the present embodiment.
Figure 10B:
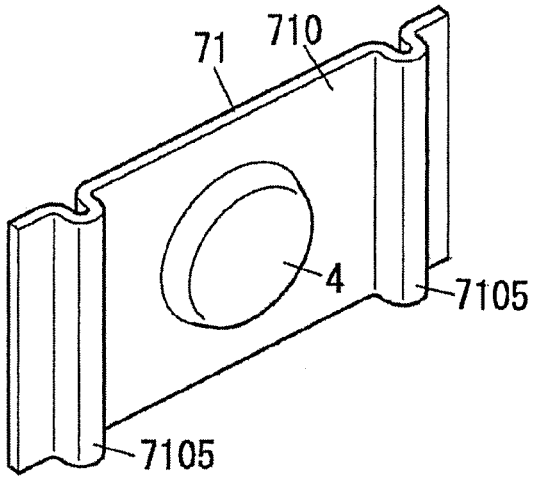
Figure 10C:
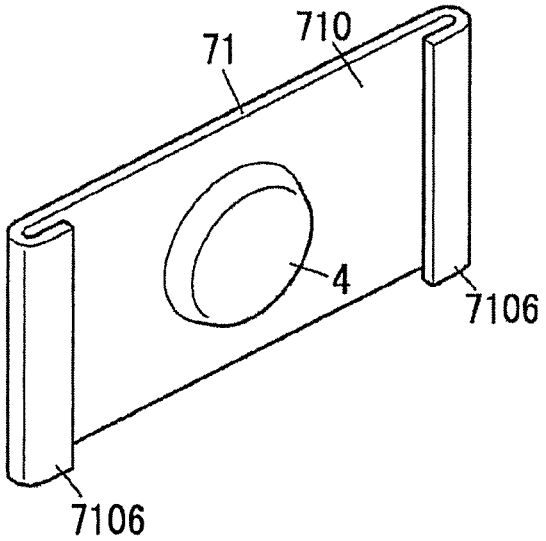

FIG. 10A to FIG. 10C are enlarged views illustrating primary parts of other examples of the contact device of the present embodiment. In FIG. 10A, protrusions 7104 are formed by bending opposite ends in the forward and rearward direction of the attachment part 710 in the same direction as the protruding direction of the movable contact 4. In FIG. 10B, protrusions 7105 are formed by bending opposite end parts in the forward and rearward direction of the attachment part 710 in a 1J-shape. In FIG. 10C, protrusions 7106 are formed by folding opposite ends in the forward and rearward direction of the attachment part 710 in the same direction as the protruding direction of the movable contact 4.

In these cases, even if the volume of the movable contact 4 is not decreased, the arc occurring on the movable contact 4 may easily move from the movable contact 4 to the protrusion 7104 to 7106 of the attachment part 710. As a result, in contrast to a case where the protrusion 7104 to 7106 is not provided, the lifetime of contacts can be prolonged. Further, the volume of the movable contact 4 is not decreased, there are advantages that the lifetime of contacts with regard to the on and off operation can be maintained and adhesion of the movable contact 4 caused by melting is not likely to occur.

Further, a necessary step is only bending or folding part of the attachment part 710, and therefore there is an advantage that processing becomes easy. Furthermore, in a case of folding an end part of the attachment part 710, there is an advantage that it is easy to adjust the level difference after assembling.

Figure 11A:
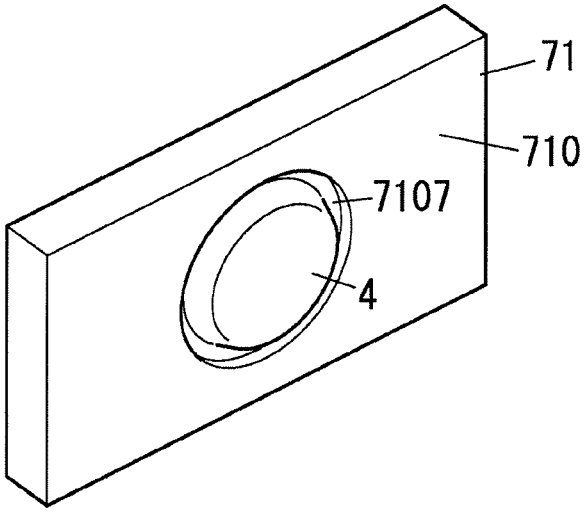
FIG. 11A and FIG. 11B are enlarged views illustrating the primary parts of other examples of the contact device of the present embodiment.
Figure 11B:
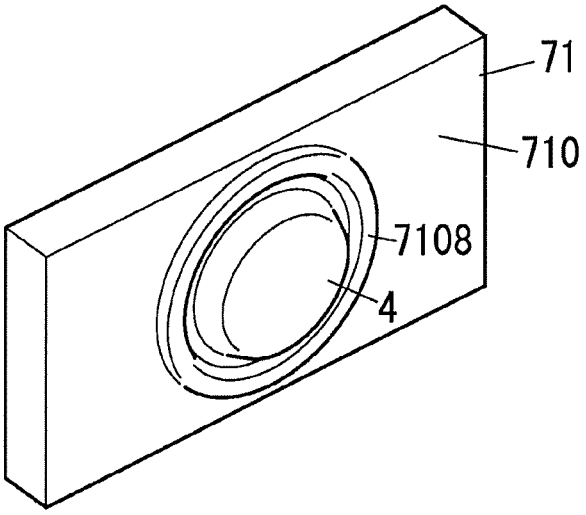

FIG. 11A and FIG. 11B are enlarged views illustrating primary parts of other examples of the contact device of the present embodiment. In FIG. 11A, a recess 7107 in a circular shape is formed in an almost center of the attachment part 710, and the movable contact 4 is situated in the recess 7107. Therefore, without decreasing the height of the movable contact 4, it is possible to obtain the same effect as in the case where the level difference between the top part of the movable contact 4 (part to be in contact with the fixed contact 3) and the surface of the attachment part 710 is decreased. Note that, in this case, the surface close to the fixed contact 3 of the attachment part 710 serves as a protrusion. In other words, the protrusion is constituted by a periphery of the recess 7107.

In FIG. 11B, a protrusion 7108 is formed by making part of the attachment part 710 to protrude in the same direction as the protruding direction of the movable contact 4 to be in a ring shape so as to surround the movable contact 4.

In these cases, even if the volume of the movable contact 4 is not decreased, the arc occurring on the movable contact 4 may easily move from the movable contact 4 to the protrusion (the periphery of the recess 7107 and the protrusion 7108). As a result, in contrast to a case where the protrusion is not provided, the lifetime of contacts can be prolonged. Further, the volume of the movable contact 4 is not decreased, there are advantages that the lifetime of contacts with regard to the on and off operation can be maintained and adhesion of the movable contact 4 caused by melting is not likely to occur.

Further, in a case of providing the recess 7107 to the attachment part, there is an advantage that processing becomes easy. Furthermore, in a case of providing the protrusion 7108 surrounding the movable contact 4, there is an advantage that an arc is allowed to move to the protrusion 7108 while a moving direction of the arc is not limited.

Note that, in the present embodiment, the protrusion is formed by use of part of the attachment part 710. However, the protrusion may be a separate part from a remaining part of the attachment part 710. In this case, it is preferable to select material of facilitating movement of an arc (e.g., material with a low work function and material with high thermal conductivity) as material of the protrusion. As a result, a breaking performance can be improved. Further, by selecting durable material, the breaking performance can be more improved.

Note that, it is preferable that the gap (level difference) between the top part of the movable contact 4 and the top part of the protrusion be less than 1 mm. Additionally, it is preferable that the protrusion be placed at a distance of 5 mm or less from an edge (outer periphery) of the movable contact 4. In this case, there is an advantage that an arc easily moves to the protrusion.

Note that, the present embodiment includes the protrusions on both sides with regard to the movable contact 4. However, the number of protrusions may be one or three or more. Further, protrusions provided as separate parts may be arranged in circle around the movable contact 4. Alternatively, protrusions formed by cutting and raising may be arranged in circle. In these cases, it is possible to obtain the same advantage that an arc is allowed to move to the protrusion while a moving direction of the arc is not limited.

Note that, the present embodiment is described with reference to examples in which the attachment part 710 of the interconnection member 71 and the movable contact 4 are provided as separate parts and the attachment piece 51 and the fixed contact 3 are also provided as separate parts. However, the attachment part 710 of the interconnection member 71 and the movable contact 4 may be formed integrally, and the attachment piece 51 and the fixed contact 3 may be formed integrally. Hence, the present invention should not be limited to the present embodiment. Further, the present embodiment is described with reference to examples in which the protrusions are provided to the movable contact member. However, the protrusions may be provided to at least one of the movable contact member and the fixed contact member. Therefore, the present invention should not be limited to the present embodiment. In other words, the protrusions may be provided to the fixed contact member or the protrusions may be provided to the movable contact member and the fixed contact member.

As described above, the contact device of the first aspect in accordance with the present invention includes a fixed contact member (the fixed contact 3 and the first terminal 5)

and a movable contact member (the movable contact 4, the second terminal 6, and the contact spring 7). The fixed contact member includes a fixed contact 3. The movable contact member includes a movable contact 4 and is movable between a position where the movable contact 4 is in contact with the fixed contact 3 and a position where the movable contact 4 is away from the fixed contact 3. At least one of the fixed contact member and the movable contact member further includes a protrusion which protrudes from a face to which a corresponding contact is provided, in a direction same as a protruding direction of the corresponding contact.

In the contact device of the second aspect in accordance with the present invention, realized in combination with the first aspect, the protrusion is a separate part from a remaining part of the at least one of the fixed contact member and the movable contact member.

In the contact device of the third aspect in accordance with the present invention, realized in combination with the first aspect, the protrusion 7100 is formed by cutting and raising part of the at least one of the fixed contact member and the movable contact member.

In the contact device of the fourth aspect in accordance with the present invention, realized in combination with the first aspect, the protrusion 7101 to 7103 is formed by causing, part of the at least one of the fixed contact member and the movable contact member, to protrude.

In the contact device of the fifth aspect in accordance with the present invention, realized in combination with the first aspect, the protrusion 7104, 7105 is formed by bending part of the at least one of the fixed contact member and the movable contact member.

In the contact device of the sixth aspect in accordance with the present invention, realized in combination with the first aspect, the protrusion 7106 is formed by folding an end part of the at least one of the fixed contact member and the movable contact member.

In the contact device of the seventh aspect in accordance with the present invention, realized in combination with the first aspect, at least one of the fixed contact member and the movable contact member further includes a recess 7107 in which the corresponding contact (e.g., the movable contact 4) is situated. The protrusion is constituted by a periphery of the recess 7107.

In the contact device of the eighth aspect in accordance with the present invention, realized in combination with any one of the second to fourth aspects, the protrusion 7108 is formed into a ring shape to surround the corresponding contact (e.g., the movable contact 4).

In the contact device of the ninth aspect in accordance with the present invention, realized in combination with the first aspect, the contact device further includes an armature 8, a driver 2, a contact spring 7, and a card 13. The driver 2 is for driving the armature 8. The contact spring 7 is for holding the movable contact 4 so as to allow the movable contact 4 to be in contact with and separate from the fixed contact 3. The card 13 interconnects the armature 8 and the contact spring 7. The card 13 is made of resilient material and is fixed to each of the armature 8 and the contact spring 7.

In the contact device of the tenth aspect in accordance with the present invention, realized in combination with the ninth aspect, the card 13 is more flexible in a direction perpendicular to a contact and separation direction of the movable contact 4 than in the contact and separation direction.

In the contact device of the eleventh aspect in accordance with the present invention, realized in combination with the ninth or tenth aspect, the card 13 is made of metal.

I claim:

1. A contact device, comprising:

a fixed contact member including a fixed contact; and a movable contact member which includes a movable contact and is movable between a position where the movable contact is in contact with the fixed contact and a position where the movable contact is away from the fixed contact, a first contact member which is one of the fixed contact member and the movable contact member further including a recess formed on a surface of the first contact member, a first contact of the first contact member protruding, from a bottom of the recess, toward a second contact of a second contact member which is an other of the fixed contact member and the movable contact member, and a periphery of the recess at least partially surrounding a periphery of the first contact in a surface perpendicular to a protruding direction of the first contact, the second contact member including a protrusion which protrudes toward the first contact member and is formed by folding an end part of the second contact member.

2. The contact device according to claim 1, wherein the periphery of the recess faces, in the protruding direction of the first contact, a surface to which the second contact of the second contact member is provided.

3. The contact device according to claim 1, wherein the first contact is attached to the first contact member so as to penetrate through the first contact member.

4. The contact device according to claim 1, wherein the periphery of the recess includes an arc-shaped periphery.

5. The contact device according to claim 1, wherein the periphery of the recess entirely surrounds the periphery of the first contact in the surface perpendicular to the protruding direction of the first contact.

6. The contact device according to claim 1, further comprising a permanent magnet configured to form a magnetic field between the fixed contact and the movable contact, the permanent magnet is arranged in a direction perpendicular to a direction in which the fixed contact and the movable contact face each other, with respect to a gap between the fixed contact and the movable contact.

7. The contact device according to claim 1, further comprising:

an armature;

a driver for driving the armature;

a contact spring, included in the movable contact member, for holding the movable contact so as to allow the movable contact to be in contact with, and separate from, the fixed contact; and a card interconnecting the armature and the contact spring, and the card being made of a resilient material and fixed to each of the armature and the contact spring.

8. The contact device according to claim 7, wherein the card is more flexible in a direction perpendicular to a contact and separation direction of the movable contact than in the contact and separation direction.

9. The contact device according to claim 7, wherein the card is made of a metal.

10. The contact device according to claim 1, wherein a shortest distance between a tip of the protrusion and the second contact being shorter than a shortest distance between a folded part of the second contact member and the second contact.

11. The contact device according to claim 1, wherein a tip part of the protrusion of the second contact member extends toward the second contact from a folded part of the second contact member.

* * * * *